US005806478A

United States Patent [19]

Oberg

[11] Patent Number: 5,806,478

[45] Date of Patent: Sep. 15, 1998

[54] VALVE ACTUATOR PUSH ROD HAVING INTERNAL LASH TAKE-UP SPRING AND OIL PUMP ASSEMBLY

[76] Inventor: Gordon D. Oberg, 1717 S. Lake Stickney Dr., Lynnwood, Wash. 98037

[21] Appl. No.: 719,323

[22] Filed: Sep. 25, 1996

Related U.S. Application Data

[63] Continuation-in-part of Ser. No. 388,248, Feb. 14, 1995, abandoned.

[51] Int. Cl.[6] ..... F01L 1/14

[52] U.S. Cl. ..... 123/90.61; 123/90.63

[58] Field of Search ..... 123/90.39, 90.45, 123/90.46, 90.52, 90.55, 90.61, 90.62, 90.63

[56] References Cited

U.S. PATENT DOCUMENTS

| | | | |
|---|---|---|---|
| 2,795,217 | 6/1957 | Ware | 123/90.62 |
| 2,874,684 | 2/1959 | Thompson | 123/90.63 |
| 2,927,566 | 3/1960 | Moye | 123/90.61 |
| 3,418,983 | 12/1968 | Sossna | 123/90.63 |
| 3,964,455 | 6/1976 | Brown | 123/90.62 |
| 4,151,824 | 5/1979 | Gilbert | 123/198 F |
| 4,453,505 | 6/1984 | Holtzberg et al. | 123/90.61 |
| 4,602,597 | 7/1986 | Rhoads | 123/90.63 |
| 5,154,145 | 10/1992 | Blane | 123/90.61 |

*Primary Examiner*—Weilun Lo
*Attorney, Agent, or Firm*—Graybeal Jackson Haley LLP

[57] ABSTRACT

A push rod is constructed with a self-contained lash take-up spring and auxiliary oil pumping assembly inserted at an end of the rod body and includes an end part slidably mounted relative to the rod body and a biasing spring that urges the end part axially to extend the push rod length to take up the play of normal lash in a valve actuator of an internal combustion engine. Axial movement of the end part is constrained between a yielding maximum extension of the push rod under spring bias and a non-yielding minimal working rod length in which the end part movement is stopped against an end of the rod body for pushing open the engine valve in reaction to cam and tappet movements. Reciprocation of the end piece relative to the rod body causes localized oil pumping action that delivers enhanced oiling through the rod body to the valve actuator parts.

15 Claims, 3 Drawing Sheets

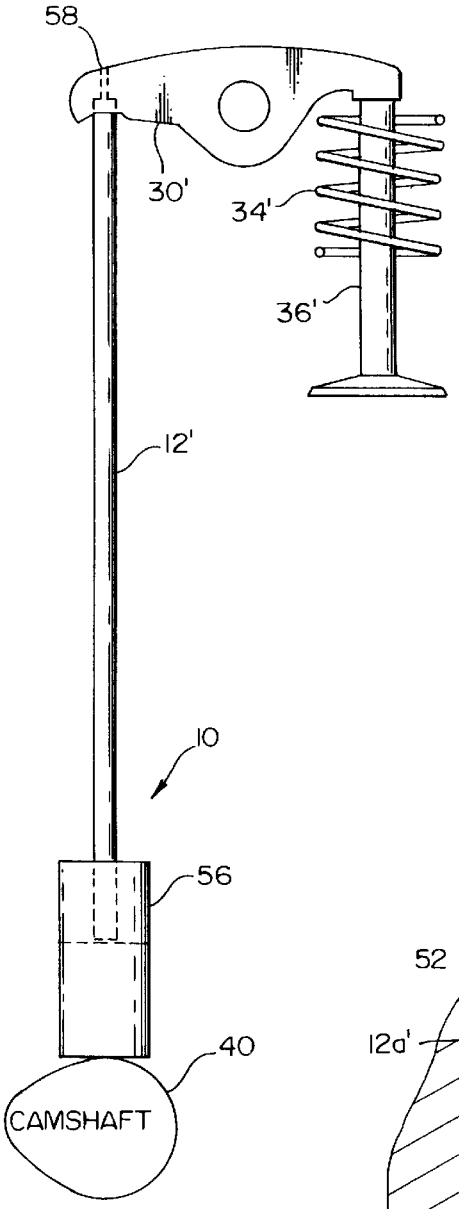
FIG. 4A
FIG. 4B
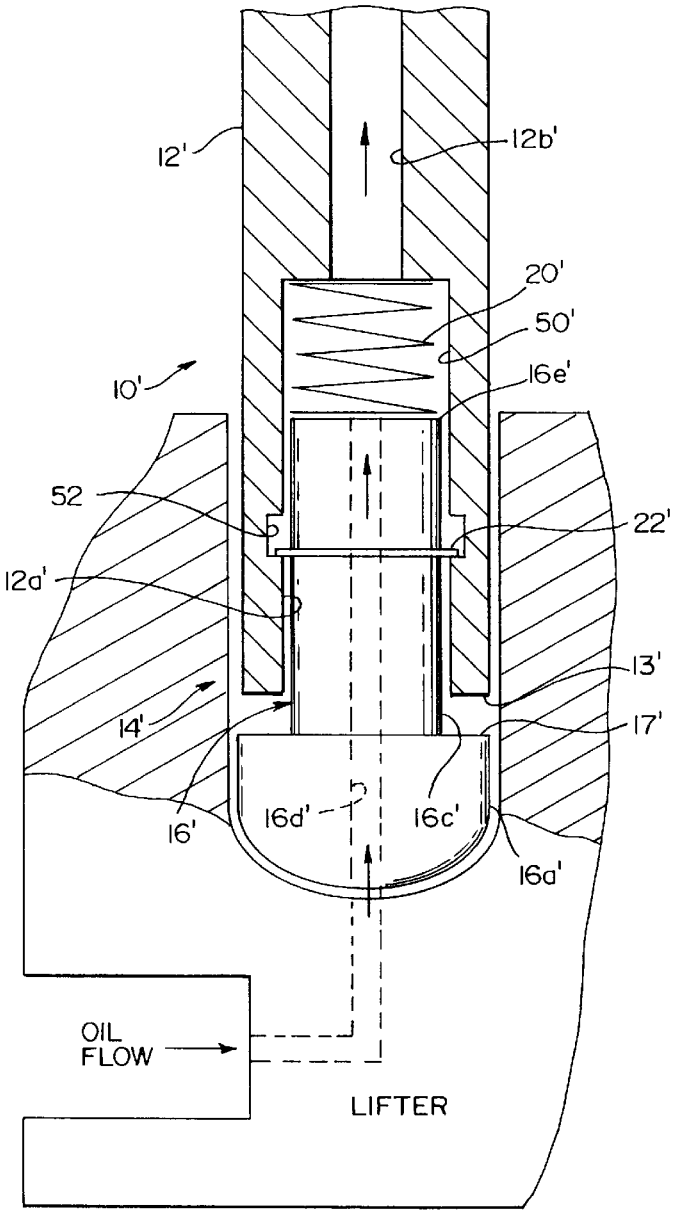

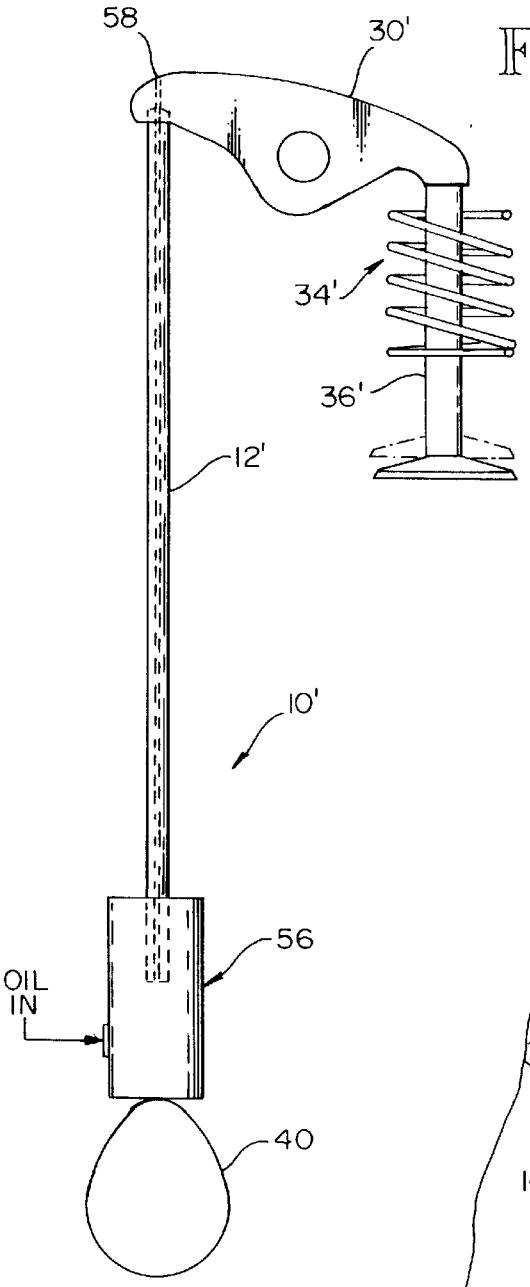
FIG. 5A
FIG. 5B
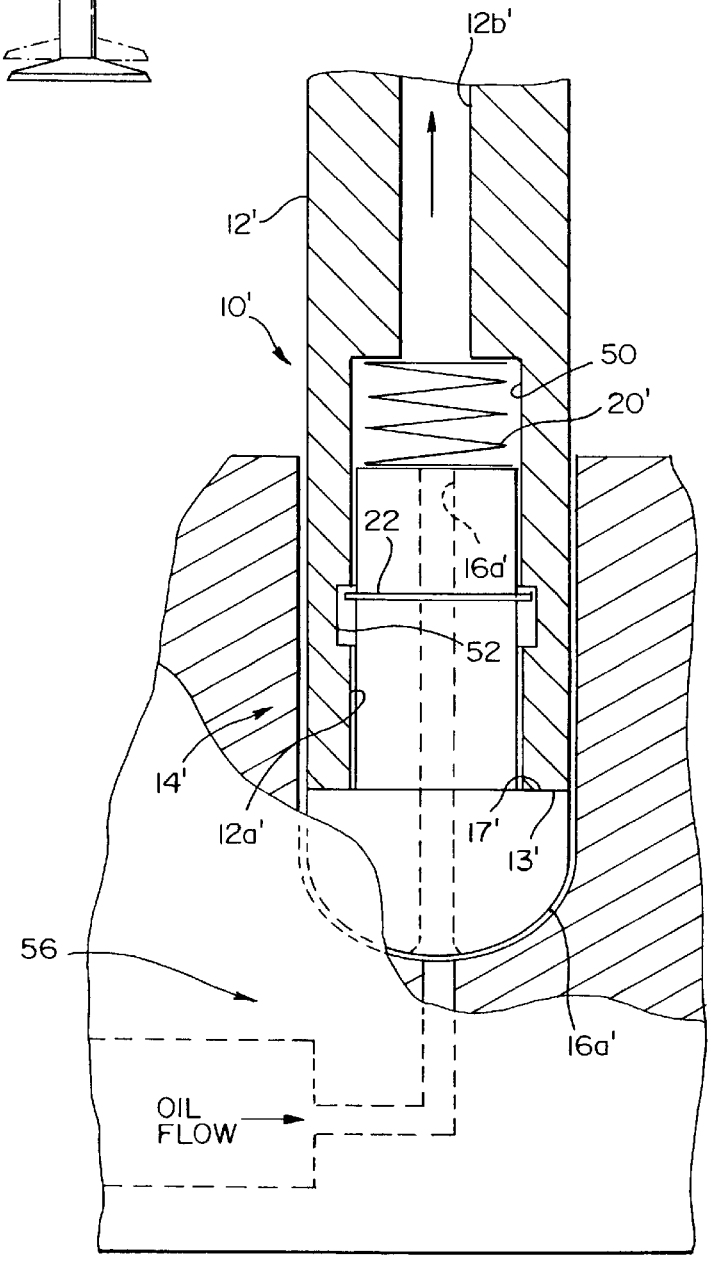

VALVE ACTUATOR PUSH ROD HAVING INTERNAL LASH TAKE-UP SPRING AND OIL PUMP ASSEMBLY

This is a continuation-in-part of application Ser. No. 08/388,248, filed Feb. 14, 1995, now abandoned.

BACKGROUND

The invention concerns an improvement in push rods used in valve actuators for internal combustion engines.

The conventional push rod is a rigid member acting in compression between a tappet reciprocated by a rotating cam and one end of a rocker arm that forces a valve open against a valve spring. In the assemblage of these components, a closed valve clearance or play, called lash, is initially set by a gap gauge or the like to ensure complete valve closure at the proper cycle of the engine piston usually corresponding to an off lobe cam position at the tappet. As the cam lobe rotates to drive the tappet, the push rod is forced along its axis, in compression driving one end of the rocker arm which in turn opens the valve against the valve spring at the opposite end of the rocker arm.

As the engine rpm is increased, the reciprocation and acceleration and deceleration forces on the valve actuator parts and specifically on the push rod attain high force levels. The lash that exists in the valve closed condition causes cycling metal to metal contact which is associated with valve actuator noise such as clatter, increased wear due to friction, metal to metal wear and diminished engine efficiency. The amount of lash initially set for the valve actuator will typically vary with wear, often increasing so that the problems of noise, increased friction and wear and still further lowering of actuator efficiency results.

SUMMARY OF THE INVENTION

A push rod is constructed with a lash take-up spring and oil pump assembly, mounted so as to be contained within at least one end of the rod body. This assembly includes an end part slidably inserted into a coaxial bore of the rod body and a biasing spring that urges the end part axially away from the mounting end of the rod body so as to create a spring biased slight axial extension of the overall rod length. In the preferred embodiment, the end assembly includes an oil pumping chamber accommodating the lash take-up spring and forming a cylinder-piston pump in communication with a coaxial oil duct in the rod that delivers oil to engine parts at the opposite end of the rod, such as to the rocker arm assembly. Means such as an internal clip mounted on a shank of the end part limit the axial movement of the part between a spring biased extension of the push rod length and a non-yielding minimal working rod length in which the end part movement is stopped against the mounting end of the rod body allowing the rod to act in full force compression to drive the rocker arm against the valve spring assembly to open the valve in reaction to the cam and tappet or lifter movements.

Further in another embodiment, the end assembly has a retainer insert fixed to one end of a hollow or tubular rod body. The insert, which may be generally cup-shaped, has an open-flanged end that seats against an axial end of the tubular rod body and has a closed recessed end. The movable end piece has a rounded head that fits against a pocket in the rocker arm or tappet lifter and a shank that slidably fits in a shank opening formed in the closed end of the cup-shaped insert. A lash take-up compression spring fits coaxially about the end piece shank and acts in compression between the recessed closed end of the insert and the underside of the head of the end part. Spring clip means is preferably used to retain the shank of the end part in the insert opening and limit the amount of axial extension or travel of the end part under the spring bias. The underside of the head forms a structure that moves down against a stop at the flange of the retainer insert and thus in effect against the axial end of the tubular rod body to transmit the compression force from the rounded head end to the rod body to accommodate the high compression force needed to operate the valve spring under the variable revolutions per minute required.

Further in the preferred embodiment, the end part has an oil bore provided along the end part axis through its shank and opening at the rounded head which communicates with the internal pump chamber and an inner axial duct in the tubular rod body for ducting oil to lubricate the corresponding end of the push rod where it engages the rocker arm or tappet. The spring biased axial movement of the end part is at least sufficient to take up the initial specified clearance or lash in the valve actuator assemblage and is preferably about 200% of the specified lash in order to continue to take up play as the parts wear between service adjustments in the valve actuator. Thus when properly and initially adjusted, the push rod has its end part slightly depressed against the lash take-up spring to approximately one half of the maximum extension. The lash take-up spring force is selected to be substantially less than the predetermined valve spring force to ensure that the rod end assembly does not deflect and thus does not partially open the valve during the valve closed portion of the camming cycle.

These and other features, advantages and aspects of the invention will become better understood by reference to the following detailed description and drawings.

BRIEF DESCRIPTION OF THE DRAWINGS

FIGS. 4*a* and 4*b* are a diagrammatic view and an enlarged fragmentary, cross-section view of the currently preferred push rod assembly shown in a valve closed phase of the engine cycle.

FIGS. 5*a* and 5*b* are views corresponding to FIGS. 4*a* and 4*b* showing the push rod assembly in a valve opened phase.

DETAILED DESCRIPTION

Figure 1:
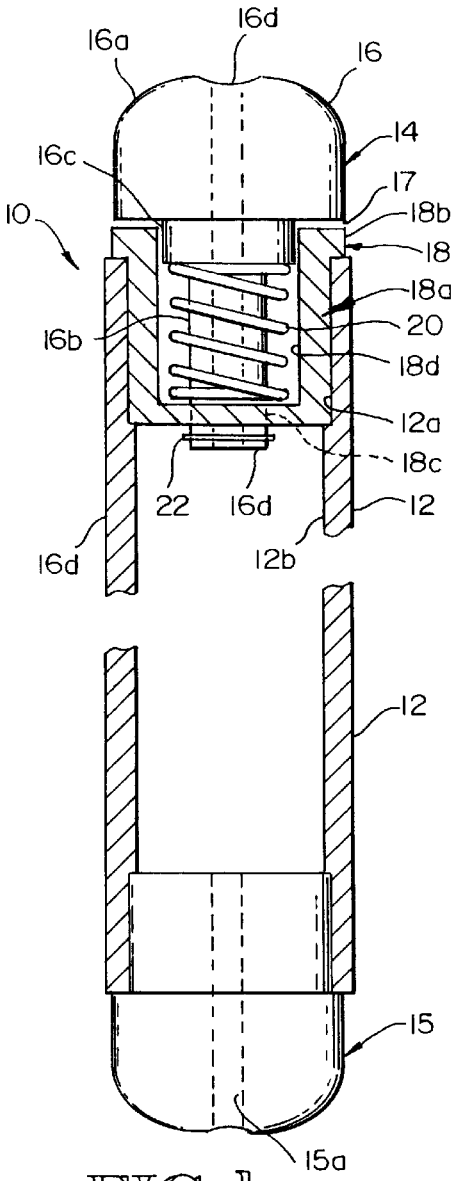
FIG. 1 is an enlarged axial section view of the push rod shown shortened from its true length by broken lines mid-body of the push rod.
Figure 2:
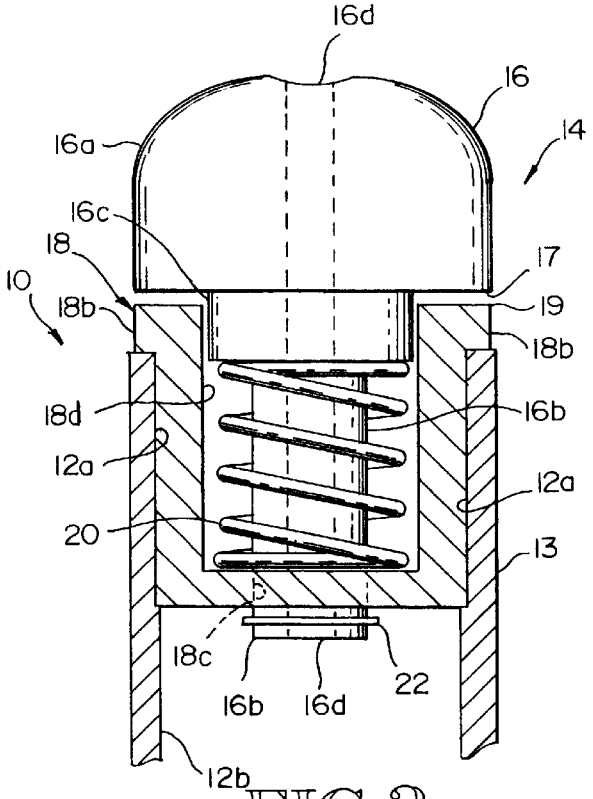
FIG. 2 is a further enlarged vertical cross sectional view of an end of the push rod of FIG. 1, showing in better detail the end assembly.

With reference to FIGS. 1 and 2, the push rod 10 in accordance with one embodiment, is constructed of a substantially rigid metal tubular rod body 12. To one end of the rod body 12, an end assembly 14 is mounted and is shown to include an end piece 16, a cup-shaped retainer 18, a lash take-up spring 20, and a retainer clip 22. End piece 16 is generally elongated axially with an enlarged rounded head portion 16*a*, a smaller diameter shank portion 16*b*, a mid-body portion 16*c* of intermediate diameter, and a central axially extending oil duct 16*d* appearing in dotted lines in the drawings. Retainer insert 18 is of generally hat or cup shape, with a cylindrical main body portion 18*a*, an end 18*b* that has a radial flange, and a closed end 18*c*. Retainer insert 18 is press-fitted into a counter bore 12*a* of tubular rod body 12 and forced inwardly into the open tubular end of the counter bore until a lip of flange 18*b* rests against the rim or axial end of rod body 12 as shown in FIGS. 1 and 2. Counter bore 12*a* forms a slight shoulder or lip 13 against which the closed axial end of insert 18 seats when press fitted into tubular rod body 12 to further ensure transmission of adequate push rod force between head portion 16*a* of the movable end part 16 and the rod body through insert 18. Alternatively, a different insert configuration or elimination of insert 18 would provide an alternative embodiment in which end piece 16 is forced directly against the end of rod body 12 to provide the full valve opening force required.

The intermediate diameter mid-body portion 16*c* of end part 16 is of generally cylindrical shape and has a sliding clearance fit into the inner diameter 18*d* as best illustrated in FIG. 2. The free end of shank 16*b* slides axially freely in an opening 18*e* (see FIG. 2) and clip 22 held in a circumferential recess of shank portion 16*b* retains it and end piece 16 in retainer insert 18, yet allows axial movement of the end piece.

An opposite end of rod body 12 may also be fitted with a like or similar end assembly so that both ends have anti-lash extensions, but usually one end piece is sufficient. Here the opposite end of the push rod is provided with a fixed end piece 15 press fitted into that end of the rod body 12. An oil duct 15*a* is formed in the axial center of fixed end part 15.

Figure 3:
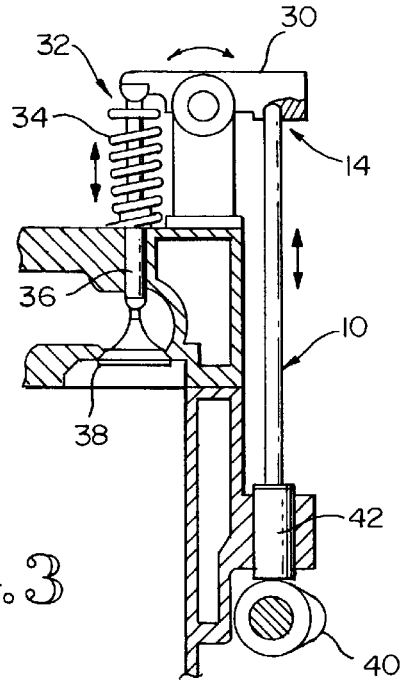
FIG. 3 is a diagrammatic view, partly in section with areas broken away, to illustrate the positioning and operation of the push rod in a valve actuator of an internal combustion engine.

With reference to FIGS. 2 and 3, during operation, the push rod 10 is installed in the valve actuator assemblage such as illustrated in FIG. 3 and the amount of lash specified for a closed valve condition is set by depressing rocker arm 30 against anti-lash push rod 10 to depress the head 16*a* of end piece 16 down into insert 18 against lash take-up spring 20. Although not shown in FIG. 2, this setup procedure causes a lower face 17 underlying head portion 16*a* of the end piece 16 to stop against the upwardly confronting shoulder surface 19 of insert flange 18*b*. By limiting the travel of end piece 16 in this manner, the amount of nominal lash in the valve actuator assemblage is set such as with a feeler gauge between rocker arm 30, shown in FIG. 3, and end 32 of the valve spring and adjacent valve stem 34 and 36, respectively. Then the rocker arm 30 is released, allowing lash take-up spring 20 to urge end piece 16 of the push rod to extend, taking up the preset lash in the valve actuator assembly. The amount of yielding extension provided by lash take-up spring 20 is pre-selected to be a fraction of the spring rate force of valve spring 34 to ensure that the valve head 38 remains closed during the off lobe position of the valve actuator. In other words, the anti-lash spring and anti-lash head assembly take up lash but do not override or force open the intended closed valve condition.

When the valve actuator cam 40 rotates or otherwise moves to cause the cam lobe to drive lifter or tappet 42 toward a valve opening position, the push rod end part is fully depressed, closing the lash gap as shown in FIG. 2 between head 16*a* and insert shoulder 19. The lash take-up spring 20 is now effectively removed from the actuator system and end part 16 acts as a non-yielding stiff unit with insert 18 and rigid rod body 12 transmitting the full cam actuating force against the spring valve and valve components 34 and 36 to force open valve head 38. The cycle continues until the valve head 38 closes and the compression force on the push rod 14 is relieved, allowing lash take-up spring 20 to take up the play by forcing head portion 16*a* of the end part axially outwardly of rod body 12.

By way of example, one embodiment of push rod 14 used an end part 16 of hardened 41–40 or 30 heat treated steel. A 50 thousands maximum gap is provided between face 17 of head portion 16*a* and shoulder 19 of insert 18, however this dimension can vary with engine design and required performance. Lash take-up spring 20 is a standard heat treated spring steel and is selected in this example to have a force of about 25 pounds over the operating deflection. Tubular rod body 12 is titanium to reduce the amount of inertia, and hence energy cost and drag, especially during high rpms.

With reference to FIGS. 4*a* and 4*b* and 5*a* and 5*b*, another and now preferred embodiment of the push rod assembly is illustrated in which lash take-up end assembly 14' is shaped and mounted at one end of rod body 12' and has an internal localized oil pumping cylinder and spring retaining chamber 50 behind the reciprocating shank of end piece 16'.

More particularly, the end piece 16' has a shank 16*c'* that is sized to slidably fit into a coaxial counterbore 12*a'* of the rod body 12'. An internal coaxial oil duct 12*b'* of diameter less than counterbore 12*a'* in rod body 12' communicates with spring and pumping chamber 50 and continues henceforth upwardly away from the pumping chamber along the length of the rod body opening at the opposite end of the push rod where it seats into rocker arm 30' as illustrated in FIG. 4*a*. A lash take-up compression spring 20' is mounted between the end face 16*e'* of shank 16*b'* and the opposed bottom wall 20' of the pumping cylinder chamber 50 to bias end piece 16 away from seating against rod body 12. Thus the underside of head 16*a'* of end piece 16' is pushed off seated contact with the rim 13' of push rod body 12' as illustrated in FIG. 4*b*.

A retainer clip 22' of the spring C-type is mounted in a circumferential recess on the shank 16*c'* of end piece 16' about mid-position of its length with a protruding edge portion of the clip 22' projecting outwardly to be retained in a recess 52 formed circumferentially in the interior wall of the counterbore 12*a'*. The axial extent of recess 52 limits reciprocation of end piece 16' but is sufficient to accommodate the intended movement, such as 50 thousandths, between its extended spring-biased lash take-up position as shown in FIG. 4*b*, and its valve opening retracted condition. The latter condition is shown in FIG. 5*b* when the underside 17' of the head 16*a'* is shouldered against the end 13' of the push rod body for forced opening of the valve against the heavier valve spring as illustrated in the companion FIG. 5*a*.

As the engine operates, rapid reciprocation of the push rod including the back and forth movement of the end piece 16 between its spring-biased lash take-up position as shown in FIG. 4*b*, and its closed retracted position shown in FIG. 5*b* causes a localized oil pumping action in chamber 50 of push rod 12'. Flow of oil that normally would occur under the nominal oil pressure of the engine through a lifter 56, conventional or hydraulic, into the coaxial oiler duct 12*b'* of the push rod is augmented by this localized pumping action.

The pumping action is due to the reciprocation of shank 16*b'* in chamber 50. Oil from lifter 56 passes up from the lifter seat, into duct 16*d'* of end piece 16' filling the pumping chamber 50 when head 16*a'* is extended. As the chamber constricts in volume due to the inward movement of the end piece shank 16*b'*, oil is forced and hence pumped, as in a piston cylinder hydraulic pump, upwardly into the relatively smaller diameter rod body duct 12*b'* where it is then discharged either at the contact seat with the rocker arm 30' or preferably through an arm dispersal port 58 provided for that purpose in the rocker arm extremity in line with or in communication with the opening of the oil duct 12*b'* at the upper end of the push rod body 12'.

The amount of pumping action and its effectiveness increases along with the increase in the reciprocation rate of the end piece 16' in rod body 12' such that at higher engine RPM with more rapid reciprocation of the push rod and end piece 16, greater local pumping action and thus increased lubrication results. Furthermore, the lash take-up spring 20' holds head 16*a*' in seated contact with lifter seat 56*a*, minimizing the amount of oil bleed at this coupling point and hence enhancing the delivery of oil to the push rod upper end at the rocker arm.

Preferably the size and hence volume of the pumping chamber 50 and the shank of the end piece 16' is selected so that a 50 to 100 thousandths axial movement of end piece 16' causes a volume displacement sufficient for the engine size and lubrication requirements. In relation, the size of the internal coaxial oiling duct 12*b*' in the main body of the push rod is preferably ½ or less than the diameter of the chamber 50.

With these considerations, this now preferred embodiment of the push rod lash take-up spring and oil pump assembly produces a highly effective mechanism for oiling the contact points at the ends of the push rod, the rocker arm and the various parts adjacent to the rocker arm as a result of oil being forced through duct 12*b*' under this augmented, localized pumping action. The invention not only minimizes the amount of free play noise and vibration that exists in the conventional push rod without the lash take-up spring-biased end piece, but also enhances the oiling of the associated parts of the engine by directing the oil to the most critical wear components and at a flow rate that increases with engine speed. Furthermore, the disclosed construction of the push rod 10' with its self-contained lash take-up end piece and auxiliary oil pump assembly being fully contained in the geometry of a typical conventional push rod allows the push rod 10' to be used as a replacement part to quiet an engine, reduce its valve actuator wear and enhance oil delivery to the related parts.

While only particular embodiments have been disclosed herein, it will be readily apparent to persons skilled in the art that numerous changes and modifications can be made thereto, including the use of equivalent means, devices, and method steps without departing from the spirit of the invention.

I claim:

1. A push rod for an internal combustion engine valve actuator comprising:

a hollow cylindrical rod body;

a lash take-up end assembly including an end part, take-up compression spring and retainer inserted to fix the assembly at an end of said hollow cylindrical rod body, said end part coaxially and slidably mounted for axial lash take-up extension of the push rod, in which the end part has a maximum diameter no greater than an outside diameter of said hollow cylindrical rod body, and said take-up compression spring is disposed within said hollow cylindrical rod body and has a spring force substantially less than that required to open an engine valve for biasing said end part toward said axial lash take-up extension, wherein free play lash vibration and associated actuator noise is reduced by a snubbing effect of said take-up compression spring and biased axial extension of the push rod end part.

2. The push rod of claim 1 wherein said end assembly further comprises a retainer insert fixed to the end of said rod body and wherein said end part is axially slidably retained by said insert, and wherein said take-up compression spring is disposed in compression between said retainer insert and said end part.

3. The push rod of claim 2 wherein said end part and retainer insert have slidably mating shank and shank receiving portions that provide the slidable mounting for axial extension and wherein said compression spring is disposed coaxially about said shank portion and is held captive between said end part and said retainer insert.

4. The push rod of claim 1 wherein said end part has an annular load bearing shoulder adjacent said rod body and said assembly further comprising means for transferring valve operating load from said end part shoulder to said rod body when said take-up compression spring is compressed.

5. The push rod of claim 2 wherein said retainer insert has an annular portion seated against the end of said rod body that is contacted by a shoulder of said end part so as to transfer valve operating compression load from said end part to said rod body.

6. The push rod of claim 1 wherein a valve actuator includes a valve spring having a predetermined valve spring force, and wherein said take-up compression spring has a lash take-up spring force substantially less than the predetermined valve spring force, whereby during operation said take-up compression spring takes up lash without deflecting the valve spring.

7. The push rod of claim 4 wherein said end part is constrained to an axial extension relative to said rod body selected to be at least the predetermined clearance of the valve actuator in an unactuated closed valve condition.

8. The push rod of claim 1 wherein the valve actuator includes a rocker arm for transferring push rod travel into valve opening motion against a valve spring, and wherein said end part is constrained to a maximum axial extension relative to said rod body selected to be at least a predetermined clearance between the rocker arm and valve spring assembly in its unactuated, valve closed condition.

9. The push rod of claim 1 wherein said rod body has an internal axial oil duct, and said end assembly comprises a cooperating oil passage communicating with the oil duct of said rod body, and wherein said end part slidably reciprocates with respect to said rod body to pump oil through said internal axial oil duct and cooperating oil passage of said assembly.

10. The push rod of claim 1 wherein said rod body is tubular with the axial opening thereof providing an oil duct, and wherein said end assembly comprises an oil opening communicating with the interior of said tubular rod body for allowing lubricating oil to flow through said interior of said tubular body and through said end assembly to lubricate valve actuator parts at an end of said push rod.

11. The push rod of claim 1 wherein said end part has a rounded head portion at its axial extent remote from said rod body and a shank portion adjacent to and axially aligned with said rod body, and means for slidably axially guiding said shank portion of said end part relative to said rod body so that said rounded head portion moves to cause said axial extension of the push rod, and said take-up compression spring is mounted coaxially with said shank portion of said end part inside said rod body.

12. The push rod of claim 11 wherein said retainer comprises an insert fitted to said rod body at the end thereof and has a shank receiving concentric bore into which said shank portion of said end part is slidably received; said take-up compression spring is mounted coaxially on said shank portion and extends axially between said retainer insert and an opposed spring shoulder on said end part adjacent the base of said shank portion; and means for limiting the axial extension of said end part relative to said retainer insert under the bias of said take-up compression spring.

13. The push rod of claim 12 wherein said rod body is tubular and has a counter bore of larger interior diameter provided in the one end of said rod body; and said retainer insert is cup shaped with an outer cylindrical surface fitted into said counter bore with the bottom closed end of said cup shaped retainer insert having said shank receiving concentric bore and an open end of said cup shaped retainer insert having an annular flange of larger diameter than said outer cylindrical surface for seating against the end edge of said tubular rod body; said shank portion projecting beyond the closed bottom of said cup shaped retainer insert and a spring clip fastener means attached to the shank portion end that protrudes through the bottom of the cup shaped insert to limit axial extension of said end part.

14. The push rod of claim 13 wherein said rounded head portion comprises an annular compression load bearing shoulder coaxial with the shank portion, and said cup shaped retainer insert has a mating annular load bearing shoulder confronting said head portion shoulder for transferring valve actuating compression load from said head portion directly to and against the end of said tubular rod body when said end part has been depressed toward the end of the rod body causing said annular shoulders to engage and provide full valve actuating force via the rigid rod body.

15. The push rod of claim 1, wherein said retainer comprises a retainer clip circumferentially mounted on a shank portion of said end part and held captive upon insertion of said assembly in an internal grove of said hollow cylindrical rod body.

* * * * *